US005099089A

United States Patent [19]

Zan

[11] Patent Number: 5,099,089

[45] Date of Patent: Mar. 24, 1992

[54] INSERTABLE ELECTRICAL CONNECTOR WITHOUT INSULATION TAPE

[76] Inventor: Vunshik Zan, c/o Hung Hsing Patent Service Center, P.O. Box 55-1670, Taipei (10477), Taiwan

[21] Appl. No.: 633,125

[22] Filed: Dec. 24, 1990

[51] Int. Cl.[5] ..... H01R 4/22

[52] U.S. Cl. ..... 174/87; 174/84 S; 174/88 S

[58] Field of Search ..... 174/87, 84 S, 88 S

[56] References Cited

U.S. PATENT DOCUMENTS

| | | | |
|---|---|---|---|
| 2,036,561 | 4/1936 | Barrett | 174/87 |
| 2,087,384 | 7/1937 | Lee | 174/84 S X |
| 2,910,525 | 10/1959 | Frank | 174/87 |
| 3,350,499 | 10/1967 | Swanson | 174/87 |
| 4,446,332 | 5/1984 | Dauser, Jr. | 174/87 |
| 4,944,699 | 7/1990 | Velke, Sr. et al. | 174/84 S X |

*Primary Examiner*—Morris H. Nimmo

[57] ABSTRACT

An electrical connector having a wire-holding plug for holding a plurality of insulated wires with their bare ends protruding inwardly or rearwardly, a conducting coupler made of electrical conductive material squeezably enclosing the bare wire ends protruding from the plug, and a protective cap embedded with the conductive coupler and engageable with the plug, so that upon an insertion of the wire-holding plug containing the wires to be connected into the protective cap, the bare wire ends protruding from the plug will be squeezably surrounded by the conductive coupler within the protective cap for a convenient electrical connector.

4 Claims, 2 Drawing Sheets

INSERTABLE ELECTRICAL CONNECTOR WITHOUT INSULATION TAPE

BACKGROUND OF THE INVENTION

A conventional way for connecting two or plural wires is to peel or strip the insulation of each wire to be connected and crimp, twist or strand the wires together, and then cover the connected wires with an insulation tape.

However, such a conventional electrical connection still has the following drawbacks:

1. The insulation tape may be stuck and broken by the stranded wires to cause leakage of electric current or electrical shock accident.

2. For test and identification purpose, the stranded wires are difficult to be distinguished once stranded or crimped, thereby influencing the test or identification jobs.

3. For dismantling the connected wires, the stranded or crimped portion of the connected wires must be cut off, wasting wire material. If the connected wires are not cut off, it is very difficult to dismantle the twisted, crimped or stranded wires. Even after dismantling the wires from their connected situation, the tips of the wires may become weak or be broken, and can not be re-used.

The present inventor has found the drawbacks of a conventional electrical connection method, and invented the present insertable electrical connector without any insulation tape.

SUMMARY OF THE INVENTION

The object of the present invention is to provide an electrical connector including a wire-holding plug for holding a plurality of insulated wires having bared ends the bare wires protruding inwardly or rearwardly, a conducting coupler made of electrical conductive material squeezably enclosing the bare wires rearwardly protruding from the plug, and a protective cap embedded with the conductive coupler and engageable with the plug, so that upon an insertion of the wire-holding plug containing the wires to be connected into the protective cap, the bare wires protruding from the plug will be squeezably surrounded by the conductive coupler within the protective cap for a convenient electrical connection.

DETAILED DESCRIPTION

Figure 1:
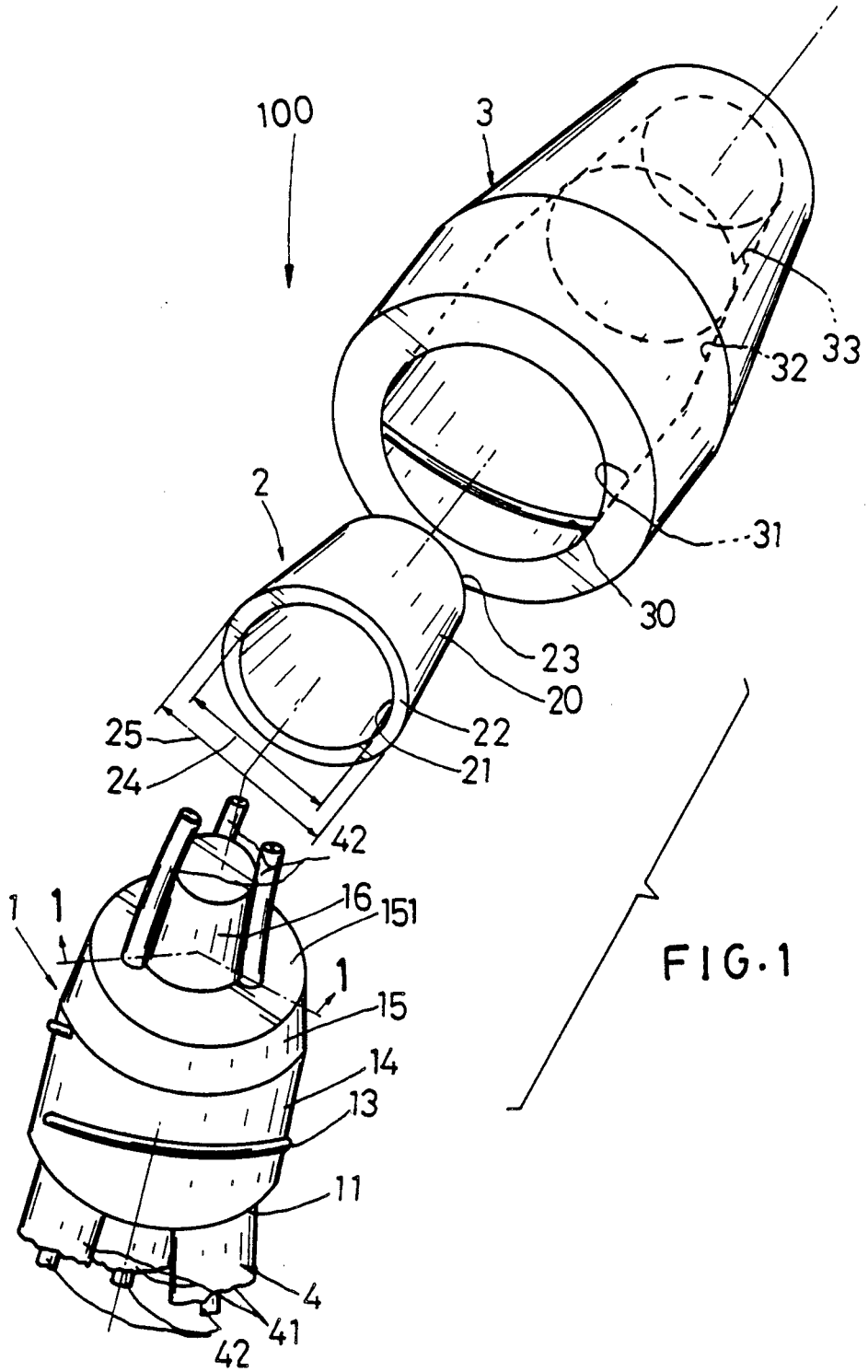
FIG. 1 is an illustration showing all elements in construction of the present invention.
Figure 4:
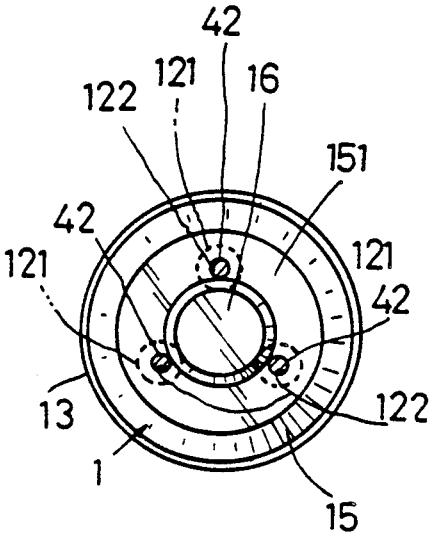
FIG. 4 is a top view of the plug as shown in FIG. 3.

As shown in FIGS. 1–4, an electrical connector 100 of the present invention comprises: a wire-holding plug 1, a conducting coupler 2, and a protective cap 3.

The wire-holding plug 1 made of electrical insulating materials includes: at least one insulated-wire hole 11 formed in a cylindrical body 14, a plurality of bare-wire holes 12 communicating with the hole 11 formed through a truncated cone portion 15 adjacent to the cylindrical body 14, a male thread 13 helically formed on a cylindrical surface of the body 14, a rear cylindrical stem 16 formed on a rear portion of the plug 1 protruding rearwardly from a shoulder portion 151 adjacent to the cone portion 15. The cylindrical stem 16 may be slightly tapered rearwardly.

The rear cylindrical stem 16 is formed on a central portion of the plug 1 along a longitudinal axis 10 of the plug 1. The plural bare-wire holes 12 are projectively (circumferentially) disposed around the rear cylindrical stem 16 so that once the insulated wires 4 are inserted into the holes 11, the bare ends 42 will protrude rearwardly through the holes 12 and be disposed around the central rear cylindrical stem 16.

Each bare-wire hole 12 includes a divergent inlet port 121 communicating with the insulated-wire hole 11 and a contraction outlet port 122 formed in the shoulder portion 151 tapered from the inlet port 121. The outlet port 122 may only allow the passing of bare wire 42, rather than the insulated wire 4. The insulated wire 4 once stripped to remove its outer insulation 41 will reveal a central conductor or bare wire 42 passing through the hole 12.

Figure 2:
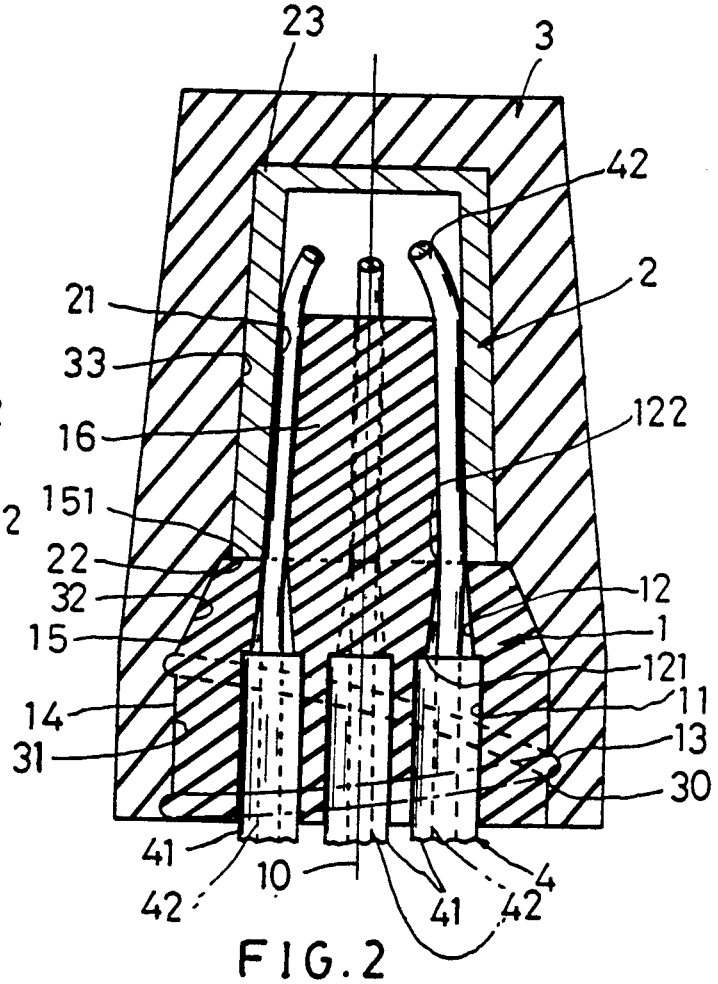
FIG. 2 is a sectional drawing as viewed from section 1—1 of FIG. 1 of the present invention when assembled.
Figure 3:
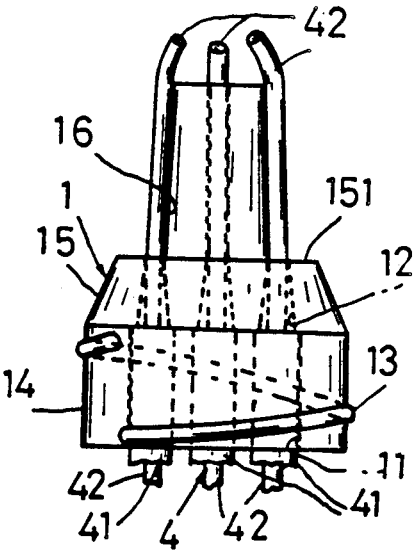
FIG. 3 is an illustration showing the wire-holding plug of the present invention.

The conducting coupler 2 generally formed as a cylindrical sleeve 20 made of electric conductive materials includes a central socket 21 formed therein, an annular seat 22 formed on a front opening of the socket 21 operatively resting on the shoulder portion 151 of the plug 1 as shown in FIG. 2, and a bottom portion 23 formed on a rear end portion of the coupler 2.

The cylindrical sleeve 20 may be slightly tapered rearwardly and includes an inside diameter 24 generally equal to a diameter of the rear cylindrical stem 16 plus two diameters of two wires 42 in view of FIG. 2.

The protective cap 3 made of electrical insulation material includes a female thread 30 helically formed on a main socket 31 recessed in the cap 3 engageable with the male thread 13 of plug 1, the main socket 31 engageable with the cylindrical body 14 of plug 1, a truncated-cone hole 32 communicating with the main socket 31 engageable with the truncated cone portion 15 of plug 1, and an inner socket 33 adjacent to and communicating with the truncated-cone hole 32 engageable and embedded with the conducting coupler 2. The diameter of the inner socket is equal to an outside diameter 25 of the sleeve 20 of coupler.

For connecting wires in accordance with the present invention, the wire-holding plug 1 containing plural insulated wires 4 is rotatably mounted into the protective cap 3 pre-embedded with the conducting coupler 2. The bare wires 42 of the insulated wires 4 disposed around the rear cylindrical stem 16 will be squeezably enclosed by the cylindrical sleeve 20 as urged by the protective cap 3 when rotated to make the engagement between the male thread 13 of plug 1 and female thread 30 in cap 3, thereby being electrically connected and conductive since the coupler 2 is made of electrically conductive materials.

Figure 5:
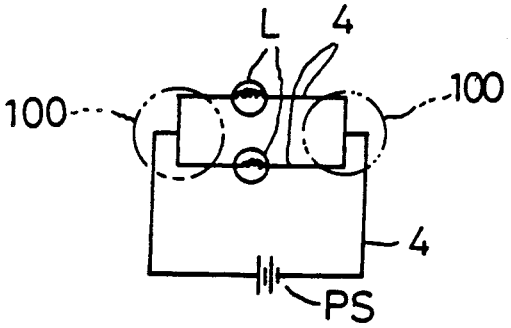
FIG. 5 shows an electric circuit by using the present invention.

As shown in FIG. 5, a typical example for the application of this invention is shown, wherein two lamps L are respectively connected with the power source PS through two connectors 100 of the present invention by means of wires 4.

The number of holes 11, 12 of this invention are not limited. The shapes of the plug 1, cap 3 and coupler 2 are also not limited in this invention, but preferably made as cylindrical shape or cone shape.

Other modifications can be made by those skilled in the art without departing from the spirit and scope as claimed in the present invention.

The present invention has the following advantages superior to a conventional electrical connection or connector:

1. By quick insertion of plug 1 into cap 3 prebuilt with the coupler 2 made of electrical conductive material, the wires can be conveniently connected and well insulated by the cap 3 eliminating any further insulation tape.

2. For repair, maintenance, test or identification purposes, the cap 3 can be removed from the plug 1 without cutting off the tips of the connected wires.

3. Any specific wire or wires, which are to be replaced with new wire or wires, can be easily withdrawn from the plug 1 once removing the cap 3 and re-inserted into the plug 1 for saving labour cost and increasing operation and maintenance easiness.

I claim:

1. An electrical connector comprising:

a wire-holding plug made of electrical insulating material having a plurality of insulated wires inserted in said plug, said insulated wires in said plug being stripped at their ends to form bare wires protruding towards a rear portion of said plug, said plug including a cylindrical body having at least one insulated-wire hole formed in said cylindrical body, a truncated cone portion adjacent to said cylindrical body having a plurality of bare-wire holes formed in said truncated cone portion and communicating with said at least one insulated-wire hole formed in said cylindrical body, a shoulder portion formed on a rear portion of said truncated cone portion, and a rear cylindrical stem protruding rearwardly from said shoulder portion positioned in front of said rear cylindrical stem;

a conducting coupler made of electrical conductive material having a central socket formed in said coupler for squeezably enclosing said bare wires protruding from said plug and circumferentially disposing around said rear cylindrical stem of said plug in said central socket of said coupler; and a protective cap made of electrical insulating material having a main socket recessed in said cap engageable with said cylindrical body of said plug, a truncated-cone hole communicating with said main socket and engageable with said truncated cone portion of said plug, and an inner socket adjacent to and communicating with said truncated cone hole of said plug for engageably embedding said conducting coupler in said inner socket of said cap.

2. An electrical connector according to claim 1, wherein said rear cylindrical stem of said plug is formed on a central portion of said plug and is slightly tapered rearwardly from said shoulder portion positioned in front of said rear cylindrical stem.

3. An electrical connector according to claim 1, wherein the plurality of said bare-wire holes are projectively circumferentially disposed around said rear cylindrical stem so that the insulated wires inserted into the at least one insulated-wire hole and the bare wires protruding rearwardly through the bare-wire holes from said at least one insulated-wire hole formed in front of said bare-wire holes are disposed around said rear cylindrical stem.

4. An electrical connector according to claim 1, wherein each said bare-wire hole includes a divergent inlet port communicating with the at least one insulated-wire hole and a contraction outlet port formed in the shoulder portion tapered from the inlet port for passing said bare wire.

* * * * *